US012139242B2

(12) United States Patent
Alhitmi

(10) Patent No.: US 12,139,242 B2
(45) Date of Patent: Nov. 12, 2024

(54) AUTOMATIC DEPLOYMENT FLOTATION DEVICE

(71) Applicant: Qatar Foundation for Education, Science and Community Development, Doha (QA)

(72) Inventor: Hitmi Khalifa Alhitmi, Doha (QA)

(73) Assignee: Hitmi Khalifa Alhitmi, Doha (QA)

( * ) Notice: Subject to any disclaimer, the term of this patent is extended or adjusted under 35 U.S.C. 154(b) by 202 days.

(21) Appl. No.: 17/701,274

(22) Filed: Mar. 22, 2022

(65) Prior Publication Data

US 2023/0312065 A1 Oct. 5, 2023

(51) Int. Cl.
*B63C 9/18* (2006.01)
*B63C 9/00* (2006.01)

(52) U.S. Cl.
CPC ..... *B63C 9/18* (2013.01); *B63C 2009/0041* (2013.01)

(58) Field of Classification Search
CPC ..... B63C 9/00; B63C 2009/0023; B63C 2009/0029; B63C 2009/0041; B63C 2009/0052; B63C 2009/0082; B63C 9/18; B63C 9/22; B63C 9/23; B63C 9/24
USPC ..... 441/88, 90, 92, 100
See application file for complete search history.

(56) References Cited

U.S. PATENT DOCUMENTS 11,851,149 B2 * 12/2023 Shoham ..... B63C 9/105
2016/0129977 A1 * 5/2016 Huang ..... B63C 9/155 441/96

* cited by examiner

*Primary Examiner* — Daniel V Venne
(74) *Attorney, Agent, or Firm* — K&L Gates LLP

(57) ABSTRACT

A personal flotation device is provided that includes a housing, a canister disposed within the housing and storing a compressed gas, an inflatable member coupled to the housing, a channel within the housing, and a compressible member positioned within the channel. The channel extends from an exit point of the canister to the inflatable member such that the canister can be in fluid communication with the inflatable member. The compressible member is configured such that (i) when the personal flotation device is located less than a predetermined depth below a surface of water, the compressible member prevents the compressed gas from the canister from reaching the inflatable member, and (ii) when the personal flotation device is located greater than or equal to the predetermined depth below the surface of water, the compressible member compresses and thereby allows the compressed gas from the canister to inflate the inflatable member.

11 Claims, 10 Drawing Sheets

AUTOMATIC DEPLOYMENT FLOTATION DEVICE

BACKGROUND

An always present risk when individuals perform activities in or on water (e.g., a pool, lake, ocean, etc.) is the risk of drowning. This risk is greater in children, individuals with disabilities, and individuals who do not know how to swim. To help reduce the risk of drowning, or prevent it altogether, individuals can use various typical devices. For example, some typical devices (e.g., a life jacket or vest) can be worn by an individual and provide buoyancy such that the individual cannot sink below the water's surface when wearing the device. An individual cannot wear such devices when learning to swim or dive, however, because the buoyancy interferes with the individual's ability to do so by keeping the individual on the water's surface. Other typical devices may also be worn by an individual, but do not provide buoyancy until activated. These other typical devices, however, often require manual activation, which does not afford as great of protection against drowning as a device that activates automatically upon being needed.

Accordingly, a need exists for a wearable flotation device that enables individuals to swim and dive while wearing the wearable flotation device, but that helps prevent individuals from drowning when needed.

SUMMARY

The present disclosure provides a new and innovative wearable personal flotation device that helps prevent individuals from drowning by automatically deploying a buoyant member (e.g., a balloon filled with a gas) upon the device reaching a certain depth (e.g., pressure) below a water's surface. The provided wearable device also does not interfere with individuals performing activities in the water (e.g., swimming and diving) because the wearable device does not provide buoyancy before being activated, which does not occur until the individual is a certain depth (e.g., pressure) below the water's surface.

In an example, a personal flotation device includes a housing, a canister disposed within the housing and storing a compressed gas, an inflatable member coupled to the housing, a channel within the housing, and a compressible member positioned within the channel. The channel extends from an exit point of the canister to the inflatable member such that the canister can be in fluid communication with the inflatable member. The compressible member is configured such that (i) when the personal flotation device is located less than a predetermined depth below a surface of water, the compressible member prevents the compressed gas from the canister from reaching the inflatable member, and (ii) when the personal flotation device is located greater than or equal to the predetermined depth below the surface of water, the compressible member compresses and thereby allows the compressed gas from the canister to inflate the inflatable member.

In another example, a personal flotation device includes a personal flotation device includes a housing, a canister disposed within the housing and storing a compressed gas, an inflatable member coupled to the housing, a channel within the housing, and a compressible member positioned within the channel. The channel extends from an exit point of the canister to the inflatable member such that the canister can be in fluid communication with the inflatable member. The compressible member is configured such that (i) when the personal flotation device is subjected to less than a predetermined water pressure, the compressible member prevents the compressed gas from the canister from reaching the inflatable member, and (ii) when the personal flotation device is subjected to greater than or equal to the predetermined water pressure, the compressible member compresses and thereby allows compressed gas from the canister to inflate the inflatable member.

Additional features and advantages of the disclosed method and apparatus are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION

The present disclosure provides a new and innovative wearable personal flotation device that automatically deploys a buoyant member (e.g., a balloon filled with a gas) from a housing upon the device reaching a certain depth (e.g., pressure) below a surface of a body of water. The provided personal flotation device includes a compressible member that, prior to activation, blocks a compressed gas stored in a canister from reaching and inflating an inflatable member. Upon the personal flotation device being submerged to the certain depth below the water's surface, the water pressure at that depth partially compresses the compressible member thereby enabling the compressed gas to reach and inflate the inflatable member. In this way, the inflatable member automatically inflates when the personal flotation device reaches the certain depth below the water's surface without any manual activation by a user. As such, the provided personal flotation device can better protect individuals against drowning as compared to typical personal flotation devices that require manual activation. Additionally, by only providing buoyancy upon the personal flotation device reaching a certain depth, the provided personal flotation device enables individuals to perform activities in the water above that certain depth without interference from the provided personal flotation device, unlike some typical personal flotation devices.

Figure 10:
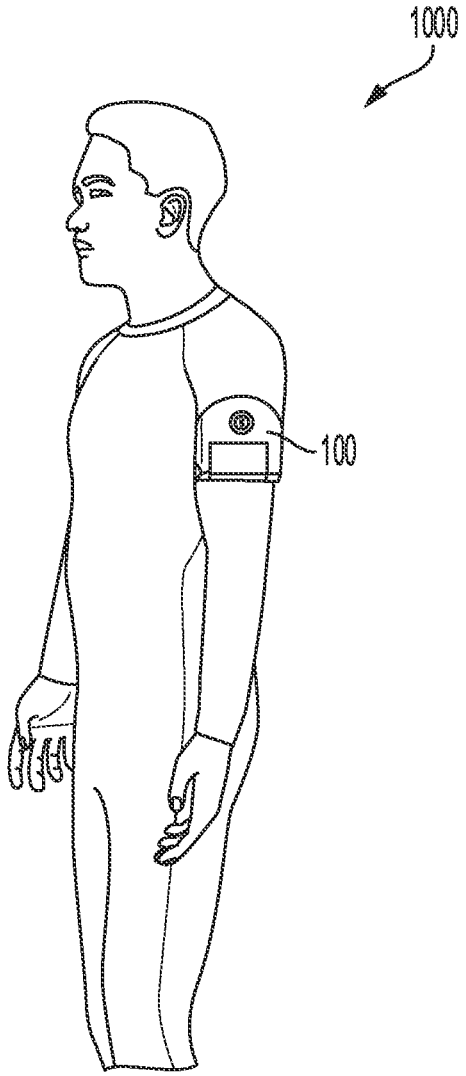
FIG. 10 illustrates a user wearing the personal flotation device of FIG. 1, according to an aspect of the present disclosure.

FIGS. 1 to 6 illustrate various views of the exterior of an example personal flotation device 100. As shown, the personal flotation device 100 may include a housing 102. In at least some aspects, the housing 102 may include a door 104 that may be opened to access the interior of the housing 102. For example, the door 104 may be pivoted about a hinge or rod. In some examples, the door 104 may form a fluid tight seal with a remainder of the housing 102. The personal flotation device 100 may include an inflatable member 106 (e.g., a balloon) secured to the housing 102. The inflatable member 106 is secured to the housing 102 (e.g., via a seal 706 shown in FIG. 7) such that the inflatable member 106 can be inflated with a suitable gas (e.g., air, carbon dioxide, etc.). In various examples, the inflatable member 106 may be constructed of a suitable elastic material, such as rubber. In at least some aspects, the personal flotation device 100 may include an adjustment knob 108 that may be used to adjust a depth (e.g., a pressure) at which the inflatable member 106 will be automatically inflated, which will be described more below. Though not illustrated, the personal flotation device 100 may include a securement member that may be used to secure the personal flotation device 100 to an individual, such as to the individual's arm (e.g., upper arm). For example, FIG. 10 illustrates an individual 1000 wearing the personal flotation device 100 on the upper arm of the individual 1000. In various aspects, the securement member may be an armband, such as a nylon armband with a typical belt securing mechanism, or an elastic armband.

Figure 1:
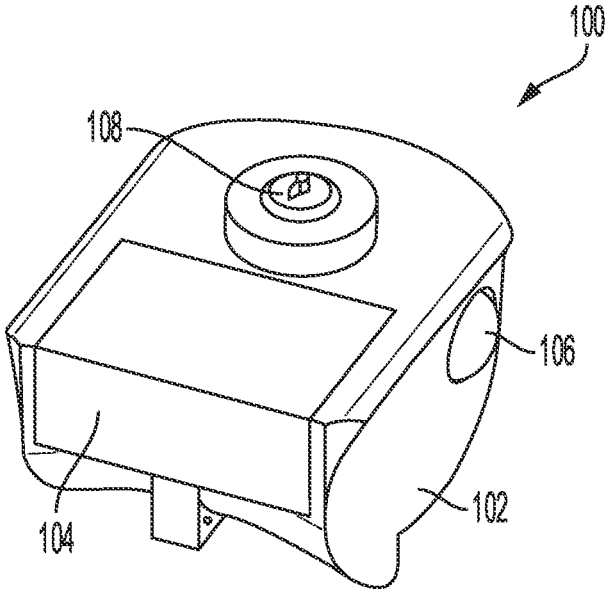
FIG. 1 illustrates a perspective view of a personal flotation device, according to an aspect of the present disclosure.
Figure 2:
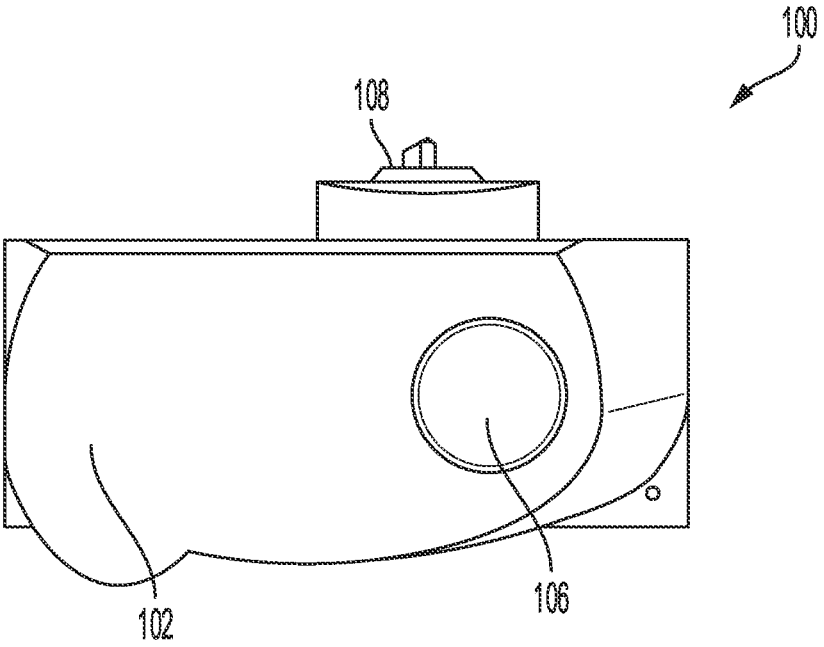
FIG. 2 illustrates a right side view of the personal flotation device of FIG. 1, according to an aspect of the present disclosure.
Figure 3:
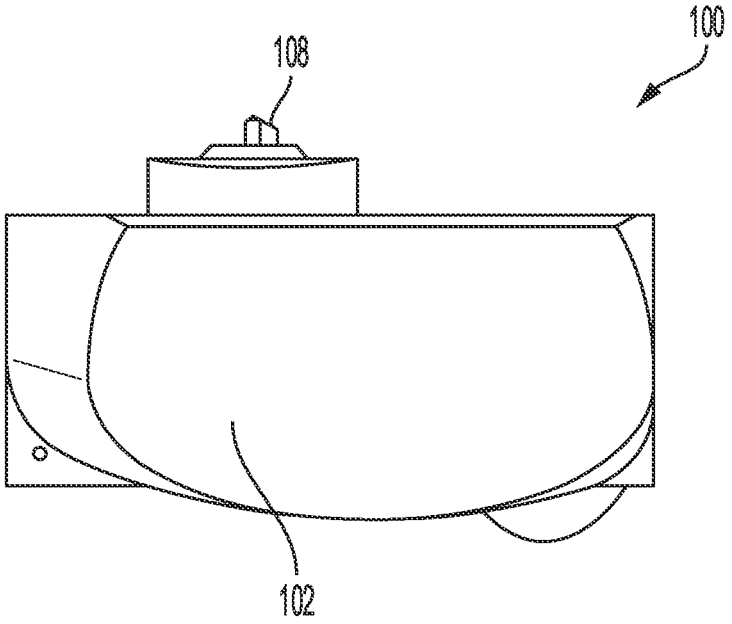
FIG. 3 illustrates a left side view of the personal flotation device of FIG. 1, according to an aspect of the present disclosure.
Figure 4:
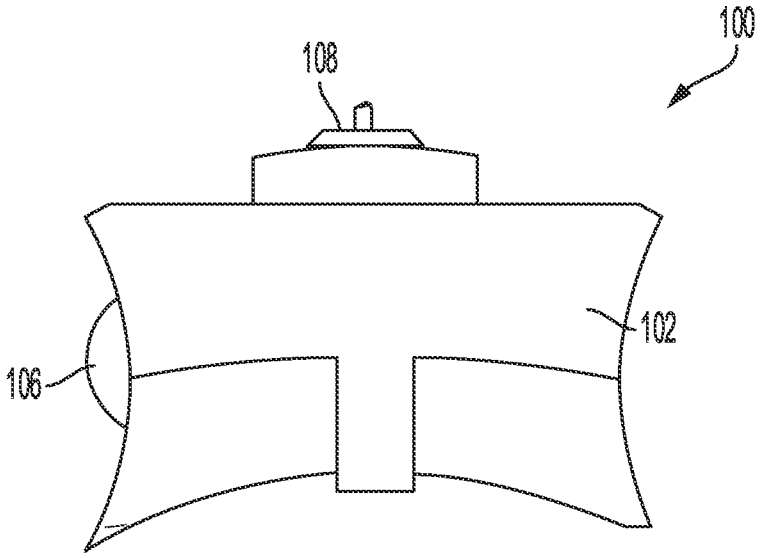
FIG. 4 illustrates a front view of the personal flotation device of FIG. 1, according to an aspect of the present disclosure.
Figure 5:
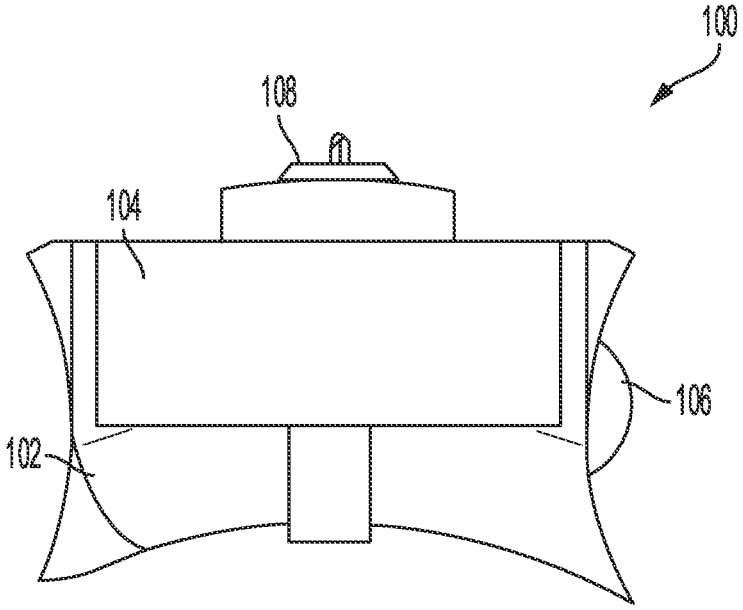
FIG. 5 illustrates a rear view of the personal flotation device of FIG. 1, according to an aspect of the present disclosure.
Figure 6:
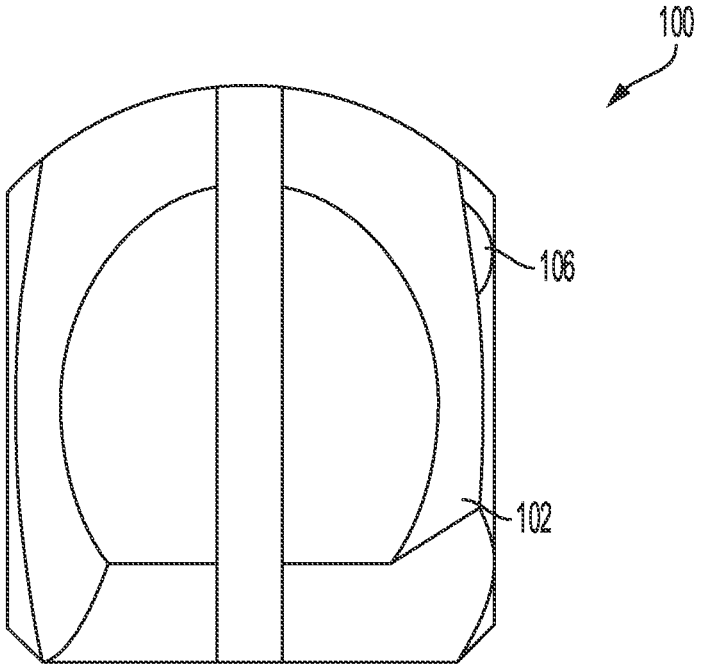
FIG. 6 illustrates a bottom view of the personal flotation device of FIG. 1, according to an aspect of the present disclosure.
Figure 7:
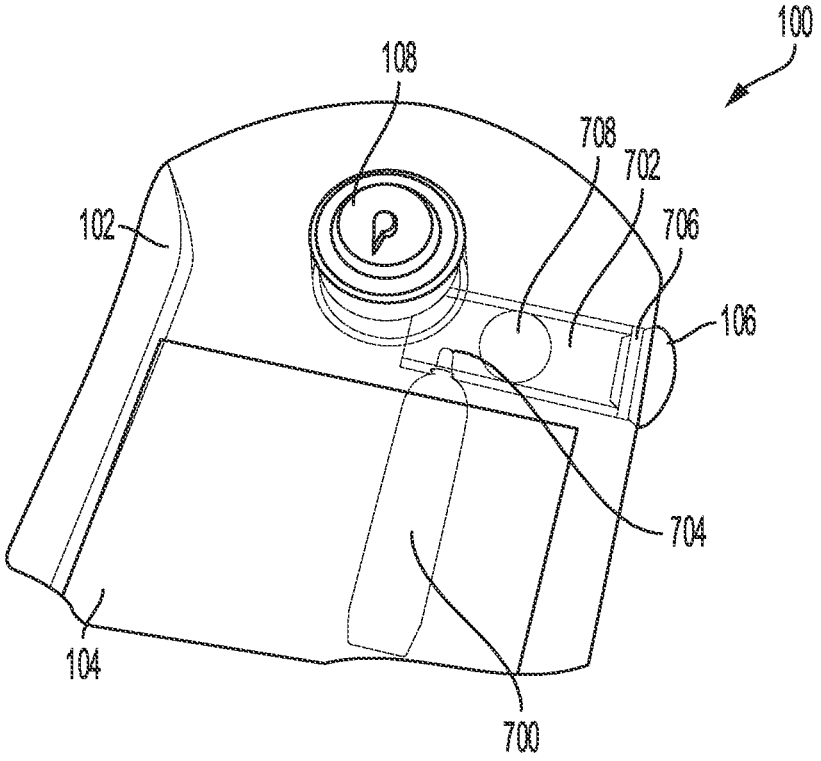
FIG. 7 illustrates a perspective phantom view of the interior of the personal flotation device of FIG. 1 prior to activation, according to an aspect of the present disclosure.

FIG. 7 illustrates the personal flotation device 100 with the housing 102 and door 104 shown transparent to illustrate the interior of the personal flotation device 100. Within the housing 102, the personal flotation device 100 includes a canister 700 storing a compressed gas (e.g., air, carbon dioxide, etc.). The canister 700 may be replaceable such that a user can replace an empty canister 700 with a new, full canister 700 (e.g., via the door 104) so that the personal flotation device 100 can be repeatedly used upon the canister 700 running out of compressed gas. The canister 700 may be in fluid communication with a channel 702. The inflatable member 106 may also be in fluid communication with the channel 702. Within the channel 702, the personal flotation device 100 includes a compressible member 708. Prior to activation of the personal flotation device 100 (FIG. 7), the compressible member 708 fills the entire cross-sectional area of the channel 702 such that the compressible member 708 blocks the passage of gas from the canister 702 to the inflatable member 106. Stated differently, upon installation of the canister 700, gas from the canister 700 enters the channel 702, but is blocked from further passage down the channel 702 by the compressible member 708 and therefore cannot reach the inflatable member 106. The compressible member 708 may be a ball or have another suitable shape such that it can fill the entire cross-sectional area of the channel 702. In various aspects, the compressible member 708 may be constructed at least partially of a metal (e.g., copper) or another suitably compressive material.

Figure 8:
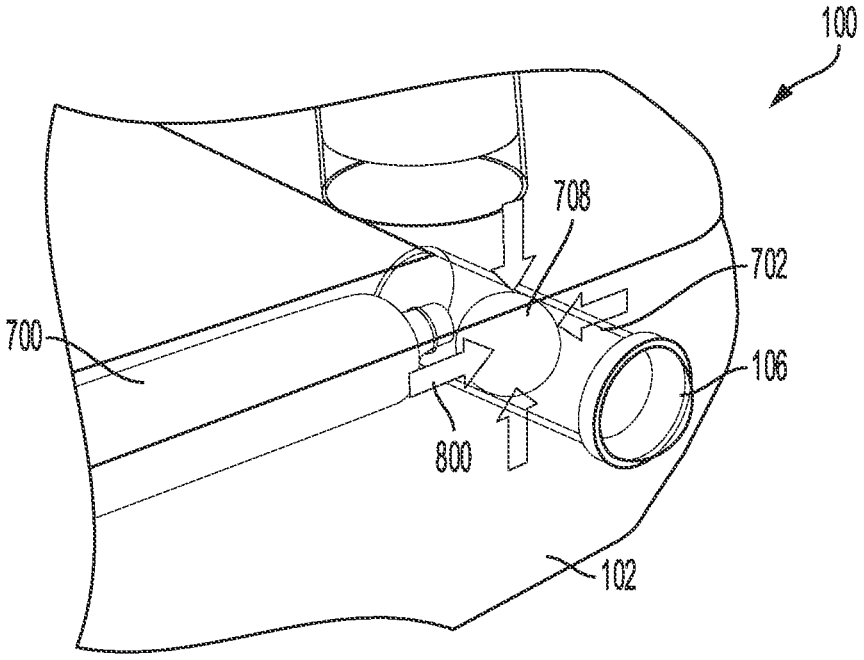
FIG. 8 illustrates a magnified view of a compressible member within a channel of the personal flotation device of FIG. 7, according to an aspect of the present disclosure.

Upon the personal flotation device 100 being submerged in water to a depth below the surface that subjects the personal flotation device 100 to a predetermined water pressure, the water pressure exerts a force (designated by the arrows 800 in FIG. 8) on the compressible member 708 that is sufficient to partially compress the compressible member 708. For example, the compressible member 708 may be partially compressed upon submerging the personal flotation device to a depth within a range of 0.5 to 5 meters, inclusive of the ends of the range. In some aspects, the range may be 0.5 to 2 meters. In some aspects, the depth may be 0.5, 1, 1.5, 2, 2.5, 3, 3.5, 4, 4.5, or 5 meters. While water pressure at a particular depth below the water's surface may depend on various factors (e.g., water temperature, salt content, etc.), these factors tend to have a minor impact. Nonetheless, in some aspects, the predetermined water pressure at which the compressible member 708 partially compresses may be different depending on the region for which the personal flotation device 100 is manufactured to be used. For example, a personal flotation device 100 constructed for use in a warmer climate may be constructed such that the predetermined water pressure is less than the predetermined water pressure of a personal flotation device 100 constructed for use in a colder climate so that both the warmer and colder climate personal flotation devices 100 deploy their respective inflatable member 106 upon being submerged to the same depth below the water's surface in their respective climates. In one example, the predetermined water pressure may be within a range of 1.07 psi to 7.11 psi, inclusive of the ends of the range. In another example, this range may be 1.07 psi to 2.85 psi. In some aspects, the predetermined water pressure may be 1.07, 1.42, 2.14, 2.85, 3.56, 4.27, 4.98, 5.69, 6.4, or 7.11 psi.

In some aspects, the predetermined depth or water pressure at which the compressible member 708 partially compresses may be adjustable. For example, a user may adjust (e.g., turn) the adjustment knob 108 to select a predetermined depth or water pressure at which the compressible member 708 will partially compress. In some aspects, the predetermined depth or water pressure is adjustable to two or more discrete values. For example, the user may turn the adjustment knob 108 to select a predetermined depth of 0.5, 1, 1.5, 2, 2.5, 3, 3.5, 4, 4.5, or 5 meters. In another example, the user may turn the adjustment knob 108 to select a predetermined depth of 0.5, 1, 1.5, or 2 meters. In other aspects, the predetermined depth or water pressure is adjustable to any value within a range of values. For example, the user may turn the adjustment knob 108 to select a predetermined depth within a range of 0.5 to 5 meters, inclusive of the ends of the range. In another example, this range may be 0.5 to 2 meters.

In order to adjust the water pressure at which the compressible member 708 will partially compress, the personal flotation device 100 may include an adjustable member (not illustrated) within the compressible member 708. The adjustable member applies a force to the interior of the compressible member 708. The adjustable member may be a ball or have another suitable shape that corresponds to the compressible member 708 such that it can apply an evenly distributed force to the interior of the compressible member 708. In at least some examples, the adjustable member may be plastic. The adjustment knob 108 is connected to the adjustable member such that the adjustment knob 108 may change a size of the adjustable member. In one example, the adjustment knob 108 may increase or decrease a diameter of the adjustable member. As such, the larger the size (e.g., diameter) of the adjustable member, the more support the adjustable member provides to the compressible member 708. When the adjustable member supplies a greater amount of support to the compressible member 708, it takes a greater water pressure to partially compress the compressible member 708. In this way, the predetermined water pressure at which the compressible member 708 will partially compress may be adjusted.

Figure 9:
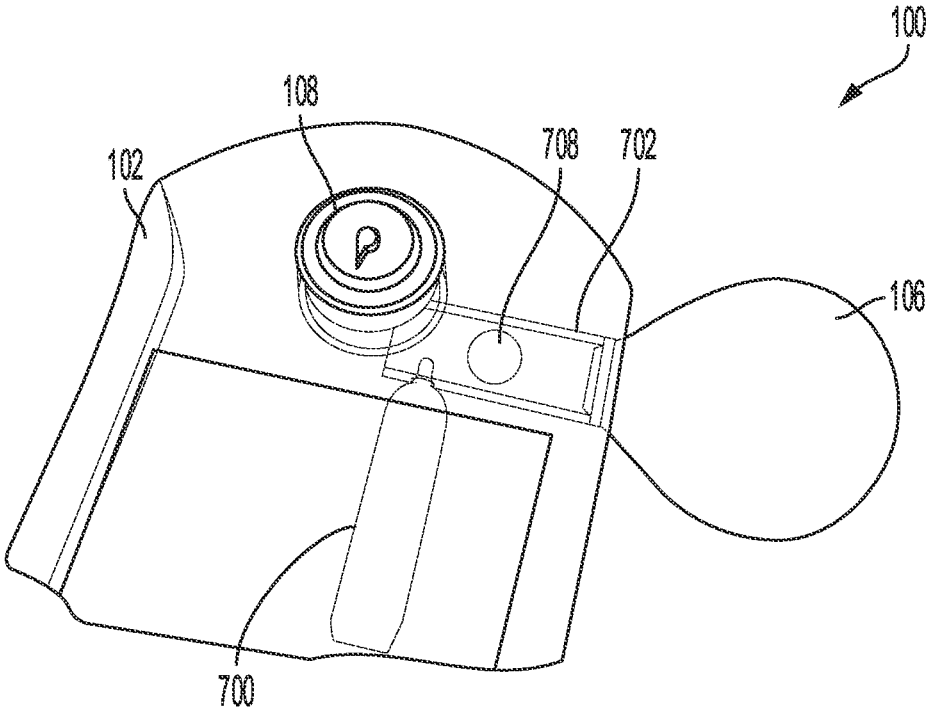
FIG. 9 illustrates a perspective phantom view of the interior of the personal flotation device of FIG. 1 subsequent to activation, according to an aspect of the present disclosure.

As shown in FIG. 9, with the compressible member 708 partially compressed, the gas from the canister 700 can travel past the compressible member 708 and inflate the inflatable member 106. In this way, the personal flotation device 100 automatically deploys a buoyant member—the inflatable member 106 filled with gas—upon the personal flotation device 100 being exposed to a predetermined water pressure without any intervention from a user wearing the personal flotation device 100. Stated differently, if an individual wearing the personal flotation device 100 were to sink to a depth below the water's surface that corresponds to a predetermined water pressure, the personal flotation device 100 would automatically inflate the inflatable member 106 without the individual pressing a button or initiating any other type of actuator. As such, the personal flotation device 100 can help prevent a person from drowning who is unable to manually activate a typical personal flotation device (e.g., a person who has lost consciousness). Additionally, the personal flotation device 100 enables an individual to perform activities in the water (e.g., swimming and/or diving) while wearing the personal flotation device 100 since the personal flotation device 100 will not provide buoyancy unless the individual is at or below the depth that corresponds to the predetermined water pressure set on the personal flotation device 100.

Without further elaboration, it is believed that one skilled in the art can use the preceding description to utilize the claimed inventions to their fullest extent. The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated.

The invention is claimed as follows:

1. A personal flotation device comprising:

a housing;

a canister storing a compressed gas, the canister disposed within the housing;

an inflatable member coupled to the housing;

a channel within the housing, the channel extending from an exit point of the canister to the inflatable member such that the canister can be in fluid communication with the inflatable member; and a compressible member positioned within the channel, the compressible member configured such that (i) when the personal flotation device is located less than a predetermined depth below a surface of water, the compressible member prevents the compressed gas from the canister from reaching the inflatable member, and (ii) when the personal flotation device is located greater than or equal to the predetermined depth below the surface of water, the compressible member compresses and thereby allows the compressed gas from the canister to inflate the inflatable member.

2. The personal flotation device of claim 1, wherein the canister is removable.

3. The personal flotation device of claim 1, wherein the compressible member is a ball.

4. The personal flotation device of claim 1, wherein the compressible member is at least partially constructed of a metal.

5. The personal flotation device of claim 4, wherein the metal is copper.

6. The personal flotation device of claim 1, wherein the predetermined depth is greater than or equal to 0.5 meters and less than or equal to 5 meters.

7. The personal flotation device of claim 1, wherein the predetermined depth is greater than or equal to 0.5 meters and less than or equal to 2 meters.

8. The personal flotation device of claim 1, wherein the predetermined depth is adjustable.

9. A personal flotation device comprising:

a housing;

a canister storing a compressed gas, the canister disposed within the housing;

an inflatable member coupled to the housing;

a channel within the housing, the channel extending from an exit point of the canister to the inflatable member such that the canister can be in fluid communication with the inflatable member; and a compressible member positioned within the channel, the compressible member configured such that (i) when the personal flotation device is subjected to less than a predetermined water pressure, the compressible member prevents the compressed gas from the canister from reaching the inflatable member, and (ii) when the personal flotation device is subjected to greater than or equal to the predetermined water pressure, the compressible member compresses and thereby allows compressed gas from the canister to inflate the inflatable member.

10. The personal flotation device of claim 9, wherein the predetermined water pressure is greater than or equal to 1.07 psi and less than or equal to 7.11 psi.

11. The personal flotation device of claim 9, wherein the predetermined water pressure corresponds to a depth below a surface of a body of water equal to 0.5, 1, 1.5, or 2 meters.

* * * * *